US006920886B2

(12) United States Patent
McCambridge et al.

(10) Patent No.: US 6,920,886 B2
(45) Date of Patent: Jul. 26, 2005

(54) MULTI-FUNCTION HAIR STYLING IRON

(75) Inventors: James E. McCambridge, Polo, IL (US); Scott A. Melton, Erie, IL (US)

(73) Assignee: Wahl Clipper Corporation, Sterling, IL (US)

( * ) Notice: Subject to any disclaimer, the term of this patent is extended or adjusted under 35 U.S.C. 154(b) by 263 days.

(21) Appl. No.: 10/289,850

(22) Filed: Nov. 7, 2002

(65) Prior Publication Data

US 2004/0089317 A1 May 13, 2004

(51) Int. Cl.[7] ..... A45D 1/04; A45D 1/00

(52) U.S. Cl. ..... 132/232; 132/269

(58) Field of Search ..... 132/232, 269, 132/271, 227, 229, 231; 219/222, 225, 226–231

(56) References Cited

U.S. PATENT DOCUMENTS

| | | | | |
|---|---|---|---|---|
| 364,956 A | | 6/1887 | Posner | |
| 959,867 A | | 5/1910 | Keefe | |
| 1,105,962 A | | 8/1914 | Carlson | |
| 1,376,416 A | | 5/1921 | Forshee | |
| 1,473,312 A | | 11/1923 | Passard | |
| 2,192,890 A | | 3/1940 | Boda | 219/24 |
| 2,243,635 A | * | 5/1941 | Karasiewicz | 132/225 |
| 2,598,330 A | | 5/1952 | Wilson | 132/14 |
| 2,988,091 A | | 6/1961 | Long | 132/31 |
| 3,516,420 A | | 6/1970 | Porter | 132/7 |
| 3,731,694 A | | 5/1973 | Moro | 132/118 |
| 3,935,423 A | | 1/1976 | Pucci | 219/225 |
| 4,163,143 A | | 7/1979 | Federico et al. | 219/225 |
| 4,257,434 A | | 3/1981 | Wahl | 132/33 R |
| 4,365,140 A | * | 12/1982 | Bast et al. | 219/225 |
| 4,368,376 A | | 1/1983 | Andis | 219/222 |
| 4,473,086 A | | 9/1984 | Thaler et al. | 132/37 R |
| 4,533,819 A | * | 8/1985 | Valiulis | 219/225 |
| D281,823 S | | 12/1985 | Sherman | D28/35 |
| 4,561,455 A | | 12/1985 | Pajak | 132/37 R |
| 4,567,904 A | | 2/1986 | Pitcher et al. | 132/33 R |
| 4,739,151 A | | 4/1988 | Smal | 219/225 |
| 4,866,248 A | | 9/1989 | Altamore | 219/225 |
| 4,866,249 A | | 9/1989 | Howard | 219/225 |
| 5,046,516 A | | 9/1991 | Barradas | 132/232 |
| D322,490 S | | 12/1991 | Altamore et al. | D28/35 |
| 5,120,933 A | | 6/1992 | Altamore et al. | |
| 5,223,694 A | | 6/1993 | Tsuji et al. | 219/225 |
| 5,400,809 A | | 3/1995 | Adams | 132/118 |
| D384,439 S | | 9/1997 | Howard | D28/35 |
| 5,673,710 A | | 10/1997 | Schaefer et al. | 132/118 |
| D389,953 S | | 1/1998 | Seifert | D28/35 |
| 5,832,939 A | | 11/1998 | Nathe | 132/225 |
| 5,868,146 A | | 2/1999 | Henninger et al. | 132/232 |
| 5,957,140 A | | 9/1999 | McGee | 132/224 |
| 6,070,596 A | | 6/2000 | Altamore | 132/224 |
| 6,667,462 B2 | * | 12/2003 | Lo | 219/225 |

FOREIGN PATENT DOCUMENTS

| | | |
|---|---|---|
| FR | 1.153.804 | 3/1958 |

* cited by examiner

*Primary Examiner*—John J. Wilson
*Assistant Examiner*—Robyn Doan
(74) *Attorney, Agent, or Firm*—Greer, Burns & Crain, Ltd.

(57) ABSTRACT

A hair styling iron includes a body with a handle end configured for being gripped by a user, and a styling end opposite the handle end. The styling end includes a first leg and a second leg, each leg having at least one heated surface. The handle end is configured for moving the second leg relative to the first leg and includes a grip portion and a pivoting portion connected to the second leg for providing pivoting movement relative to the first leg. The pivoting portion of the handle end and the second leg are connected to the body to operate in scissors fashion relative to the first leg. A curling clamp is pivotally connected to the body for exerting a clamping force against one of the first and second legs. A latch is associated with the handle end for releasably securing the pivoting portion to the grip portion.

16 Claims, 4 Drawing Sheets

MULTI-FUNCTION HAIR STYLING IRON

RELATED APPLICATION

This application is related to commonly-assigned U.S. Ser. No. 29/170,612, filed on Nov. 7, 2002 for HAIR STYLING IRON, now U.S. Pat. No. D491,309.

BACKGROUND OF THE INVENTION

The present invention relates to hair styling devices, and particularly to hair styling irons, including but not limited to curling irons.

Conventional curling irons used by consumers and professional stylists employ an unheated clamp against a heated barrel. The barrel and clamp are typically curved to create gradual, radiused curls in the hair. Hair caught by the clamp and pressed against the barrel is styled as desired by the user or stylist. Often a rotating or twisting motion is used to obtain the desired look. When straightening of hair is desired, it has been necessary to employ a separate utensil, known as a flat iron or straightening iron, employing at least one heated surface. A main difference between curling irons and straightening irons is that the latter employ flat surfaces and relatively straight edges for clamping the hair and applying heat so that natural or artificially induced curls are relaxed and/or removed.

A drawback of conventional straightening irons is that they typically include a pair of arms which are pivotally joined or hinged at or near one common end, and are spring-loaded to the open position. In that respect, they resemble cooking tongs. Thus, a user must grip the two arms at the pivot end, and exert a force to close the arms about the hair to be straightened.

For professional hair stylists working for long periods, the force required to both grip the iron and exert the requisite clamping force can be fatiguing. Also, since the arms are pivoted at the far end of the unit opposite the heated end, it is often difficult to properly control the iron to obtain the desired results.

In some cases, it has been difficult, using conventional curling irons, to obtain gentle flips or waves at the hair ends. In other cases, it has been difficult to both straighten and provide gradual flips or waves with the same iron.

Thus, there is a need for a hair styling tool combining the features of a curling iron and a straightening iron, and which addresses the needs of stylists to exert more control over the irons for improved styling control. Furthermore, there is a need for a hair styling iron which does not require the gripping effort of conventional tong-like irons.

SUMMARY OF THE INVENTION

Accordingly, the above-identified needs are addressed by the present multi-function hair styling iron featuring a pair of separately heated styling legs which are movable between an open and a closed position. A latch is provided for retaining the legs in the closed position. In addition, a curling clamp is provided for performing conventional hair curling when the legs are placed in the closed position. In the open position, the legs may be selectively closed for performing styling functions, such as hair straightening. Another feature of the present iron is that the legs are configured to operate with a scissors action, thus requiring less effort for controlling the relative leg position when open. Still another feature is a latch provided for maintaining the legs in a closed position for operation with a spring-loaded clamp as a standard curling iron.

More specifically, in one embodiment, the present hair styling iron includes a body with a handle end configured for being gripped by a user, and a styling end opposite the handle end. The styling end includes a first leg and a second leg, each leg having at least one heated surface. In addition, the handle end is configured for moving the second leg relative to the first leg and includes a grip portion and a pivoting portion connected to the second leg for providing pivoting movement relative to the first leg. The pivoting portion of the handle end and the second leg are connected to the body to operate in scissors fashion relative to the first leg. A curling clamp is pivotally connected to the body for exerting a clamping force against one of the first and second legs. A latch is associated with the handle end for releasably securing the pivoting portion to the grip portion.

DETAILED DESCRIPTION

Figure 1:
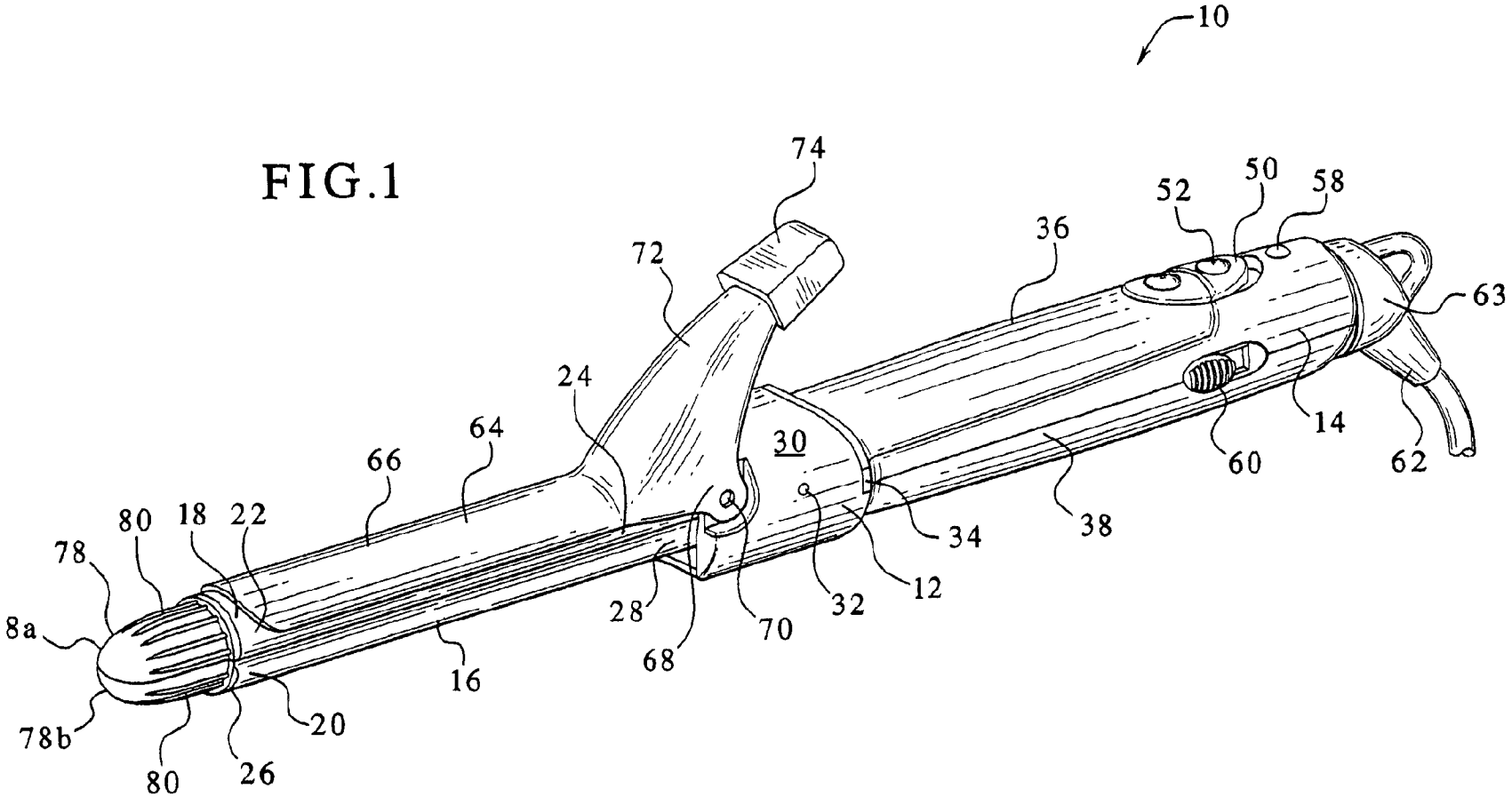
FIG. 1 is a top perspective view of the present styling iron shown in a closed position.

Referring now to the drawings, a hair styling iron suitable for incorporating the features of the present invention is generally designated 10 and includes the features of both a standard curling iron and a straightening iron in a single unit. The present iron 10 includes a body 12 having a handle end 14 configured for being gripped by a user, and a styling end 16 opposite the handle end.

Figure 2:
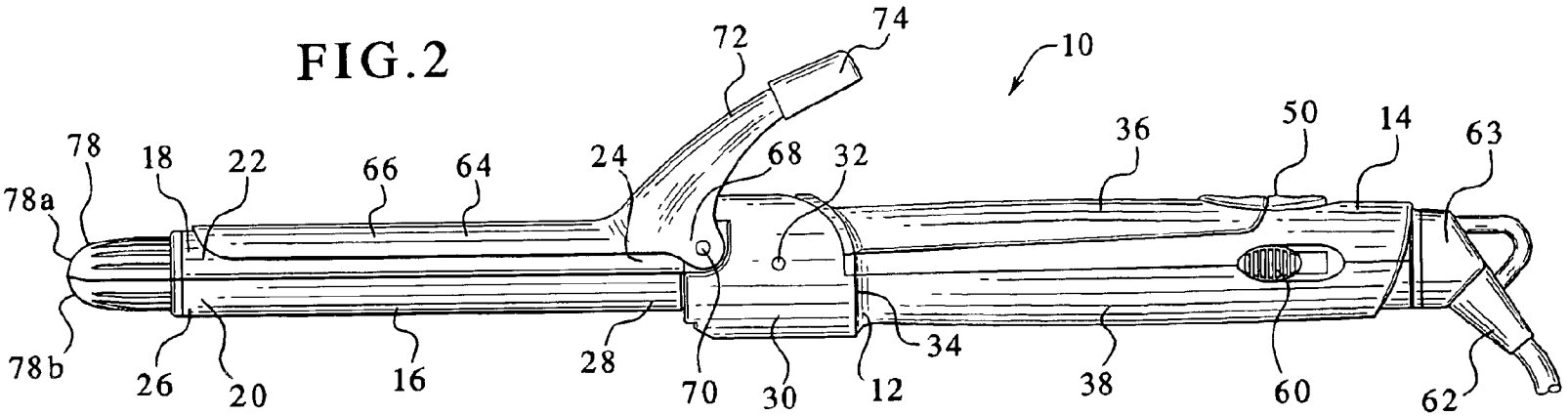
FIG. 2 is a side elevational view of the styling iron of FIG. 1.
Figure 6:
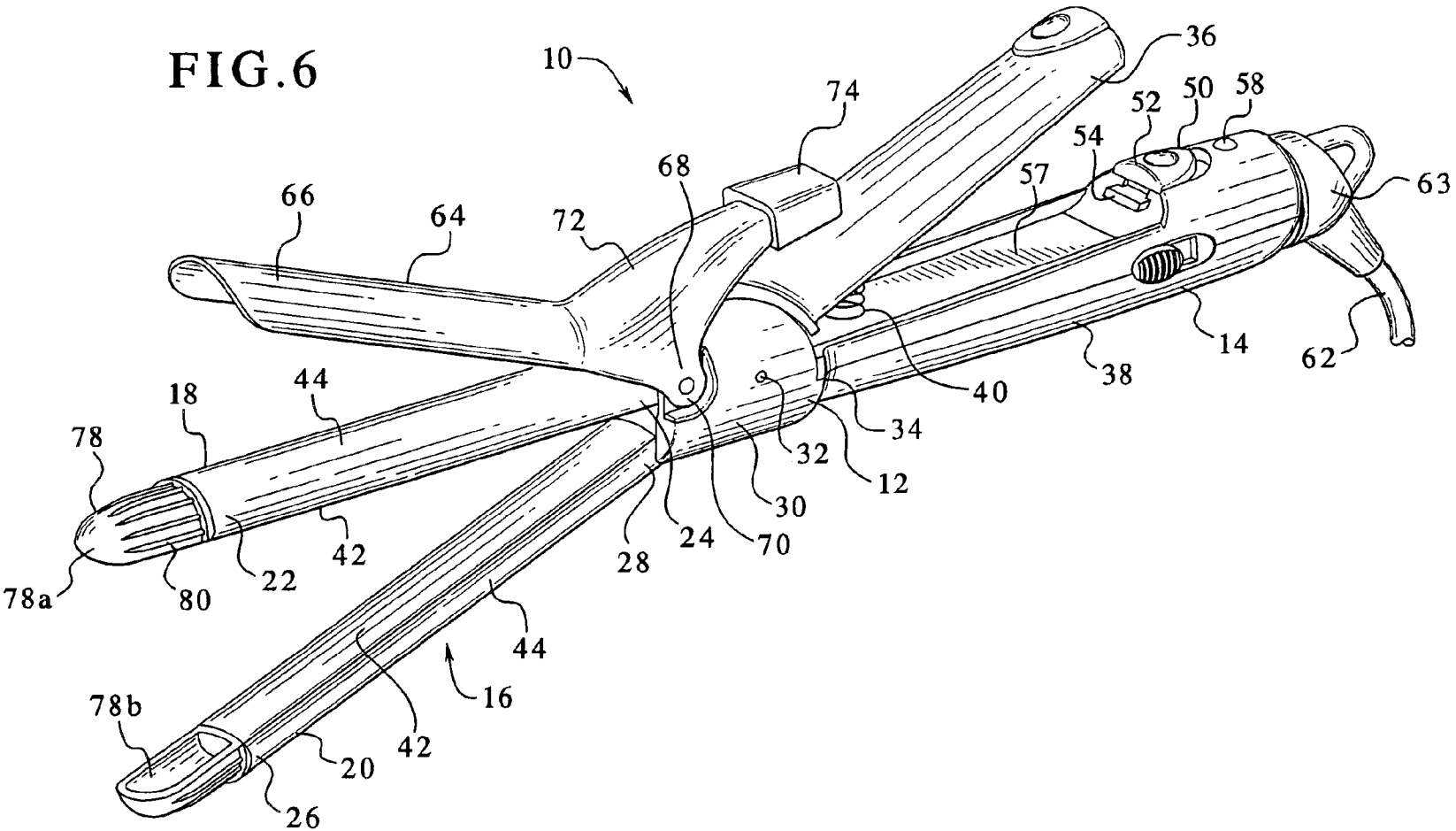
FIG. 6 is a perspective view of the styling iron of FIG. 1 shown in the open position with the clamp opened.

The styling end 16 includes a first leg 18 and a second leg 20. In the preferred embodiment, the first leg 18 is disposed above the second leg 20 when the iron 10 is oriented as shown in FIGS. 1, 2 and 6. However, it is contemplated that the first leg 18 could be located below the second leg 20, depending on the application. The first leg 18 has a tip end 22 and a hinge end 24 located opposite the tip end. Similarly, the second leg 20 has a tip end 26 and a hinge end 28. Both hinge ends 24, 28 are operatively associated with a center portion 30 of the body 12, which is preferably located generally midway between the handle end 14 and the styling end 16. In the preferred and illustrated embodiment, the hinge end 24 of the first leg 18 is fixed to the center portion 30 and the hinge end 28 of the second leg 20 is pivotable relative to the center portion about a transverse pivot axis represented by a pin 32. The manner of fixing the first leg 18 to the center portion 30 may be achieved using any suitable technology known to skilled practitioners, including but not limited to ultrasonic welding, chemical adhesives, inset molding and threaded fasteners. It is also contemplated that alternatively, the second leg 20 may be fixed to the center portion 30 and the first leg 18 pivotally joined thereto.

A rear end 34 of the center portion 30 provides the attachment point for the handle end 14, which includes a pivoting portion 36 and a grip portion 38. Similar to the first leg 18, the grip portion 38 is fixed to the center portion 30. The pivoting portion 36 is preferably secured to the second leg 20 to pivot as a unit about the pivot pin 32 (see hidden lines 39 in FIGS. 3 and 4). Also, a spring 40 is provide to bias the second leg 20 to an open position (best seen in FIG. 4), which also moves the pivoting portion 36 away from the grip portion 38. Thus, the handle end 14 is configured for moving the second leg 20 relative to the first leg 18. A feature of the present styling iron 10 is that in view of the scissors action of the legs established by the pivot pin 32 being disposed in the center portion 30, the user has more control over the amount of clamping force exerted by the second leg 20 against the first leg 18. This is important when the iron 10 is used for straightening hair or creating relaxed soft curls. In contrast, when using conventional tong-type straightening irons, the user must exert a relatively greater force for holding the legs together.

Figure 4:
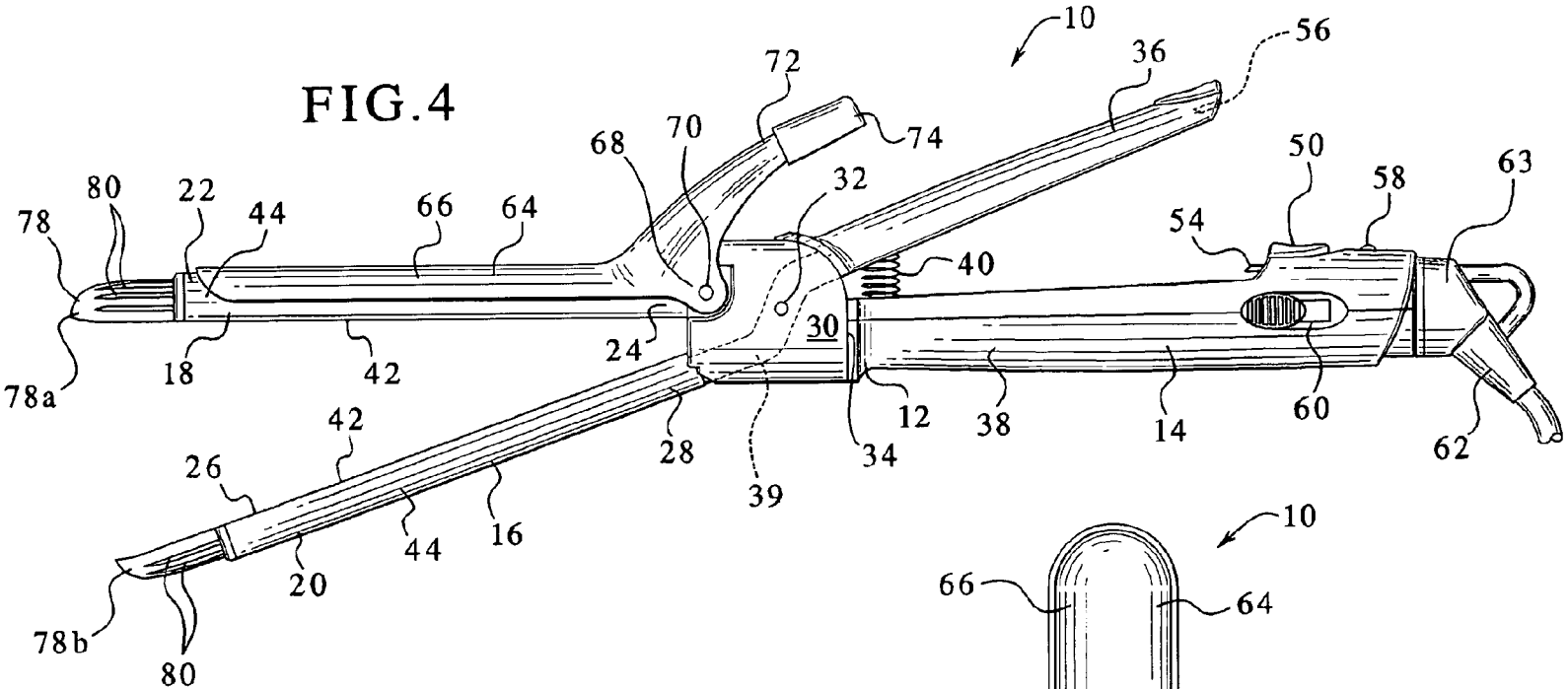
FIG. 4 is a side elevational view of the styling iron of FIG. 1 shown with the heated legs in the open position.
Figure 5:
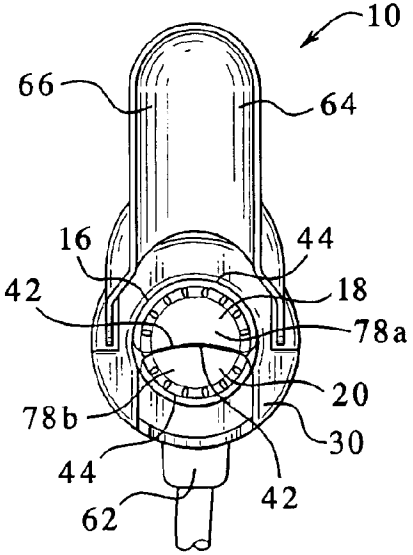
FIG. 5 is an end view of the styling iron of FIG. 3.

Referring now to FIGS. 4, 5 and 6, each leg 18, 20 is provided with an opposed, relatively planar surface 42, and a relatively semicircular surface 44. Referring now to FIG. 5, the relatively planar surfaces 42 preferably have a slight radius and are complementarily curved so that one surface is concave and the other convex, and either leg, 18, 20 is contemplated as having either one of the surface shapes. The relatively semicircular surfaces 44 are configured so that, when closed, the styling end 16 defines a cylindrical shape, and viewed in cross-section, defines a circle, however other shapes are contemplated, depending on the application. It is preferred that the legs 18, 20 are generally tubular and are made of a heat conductive material such as aluminum or the like. Also, it is preferred that at least one of the surfaces 42, 44 is heated. In the preferred embodiment, both surfaces 42, 44 are heated, as by an internal heating element such as a coil or the like (not shown) as is well known in the art.

Referring now to FIG. 4, as described above, the pivoting portion 36 is pivotable relative to the grip portion 38 of the handle end 14. Once the legs 18, 20 are in the closed position (best seen in FIG. 1), another feature of the present iron 10 is that at least one latch 50 is provided which is configured for releasably securing the legs 18, 20 in the closed position, as well as connecting the pivoting portion 36 to the grip portion 38. While other configurations are contemplated, the latch 50 includes a depressable button 52 which includes a tang 54 shaped to matingly engage a recess 56 (shown hidden) on the pivoting portion 36. The tang 54 and the recess 56 are configured so that depression of the button 52 causes the disengagement of the tang from the recess, which allows the pivoting portion 36 to move away from the grip portion 38 under the biasing force provided by the spring 40. In the closed position (best seen in FIG. 1), the handle portion 14 defines a generally cylindrical configuration. As such, and referring to FIG. 6, the grip portion 38 defines a recess 57 configured for accommodating a portion of the pivoting portion 36.

Also preferably located on the handle end 14 is a visual indicator 58 such as an LED, which notifies a user that the iron 10 is being heated. In addition, an on/off switch 60 (FIGS. 1, 2, 3 and 4) is preferably located on the grip portion 38, as is a power cord 62 having a cord saver 63. The precise location for the switch 60 may vary depending on the application.

Referring now to FIGS. 1, 3, 5 and 6, another feature of the present iron 10 is the provision of a curling clamp 64 pivotally connected to the body 12 for exerting a clamping force against one of the first and second legs 18, 20. As is the case with conventional curling irons, the curling clamp 64 is configured for exerting a biasing force against the relatively semicircular surface 44 of the first leg 18. More specifically, the curling clamp 64 includes a blade 66 which is curved to complement the surface 44 of the first leg 18, a pair of pivot eyelets 68 projecting rearwardly from the blade 66 to engage a blade pin 70 on the center portion 30, and a handle 72. In the preferred embodiment, the handle 72 is provided with a protective cap 74 made from a resilient, ergonomically shaped material, however the presence, size, shape and/or material of the cap is variable depending on the application.

Figure 3:
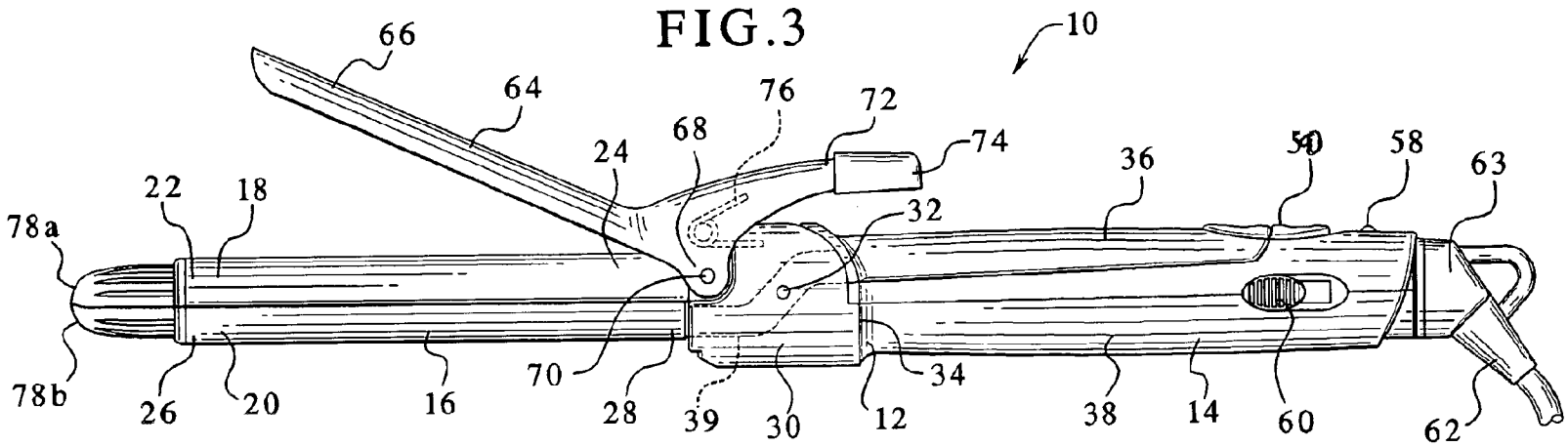
FIG. 3 is a side elevational view of the styling iron of FIG. 2 shown in the open clamp position.

The clamp 64 is biased against the first leg 18 through the action of a clamp spring 76 (shown hidden in FIG. 3) disposed between the clamp 64 and the body 12 as is known in the art. In operation, as seen in FIGS. 3, 5 and 6, the clamp 64 is elevated relative to the first leg 18 by depression of the cap 74 towards the handle end 14. Upon release of the cap 74, the clamp 64 resumes the position shown in FIGS. 1 and 2. It will be seen that the curling clamp 64 is controllable independently of the position of the legs 18, 20.

Referring now to FIGS. 1 and 4, another feature of the iron 10 is an insulating tip 78 disposed at the styling end 16. As is known in the art of hair styling irons such as curling irons, the insulating tip 78 is made of an insulating material which allows gripping and manipulation by a user during styling. In the preferred embodiment, the insulating tip 78 is provided with a plurality of radially projecting cooling fins 80. It will be understood that the presence, specific number, orientation and/or shape of the fins 80 may vary to suit the application. Also, in view of the dual leg construction of the present iron 10, the insulating tip is provided in two pieces, 78*a*, 78*b*, each of which corresponds to one of the legs 18, 20. In the preferred embodiment, the insulating tip pieces 78*a*, 78*b* are inserted into an open end of the legs 18, 20 and held there by friction fit, however the use of chemical adhesives, fasteners or other known fastening technologies is contemplated.

Thus, it will be seen that the present multi-function hair styling iron addresses the above-listed drawbacks of conventional styling utensils, in that a single unit can be used for either curling or straightening, as well as styling. Both legs are heated, to facilitate hair straightening and styling. Also, the scissors-type pivoting action of the dual legs facilitates control by the stylist and reduces long term operational fatigue. By latching the legs together, the unit can operate as a conventional curling iron.

While specific embodiments of the multi-function hair styling iron of the present invention have been shown and described, it will be appreciated by those skilled in the art that changes and modifications may be made thereto without departing from the invention in its broader aspects and as set forth in the following claims.

What is claimed is:

1. A hair styling iron, comprising:

a body having a handle end configured for being gripped by a user, and a styling end opposite said handle end;

said styling end including a first leg and a second leg, each said leg having at least one heated surface;

said handle end being configured for moving said second leg relative to said first leg and including a grip portion and a pivoting portion connected to said second leg for providing pivoting movement relative to said first leg, said pivoting portion of said handle end and said second leg are connected to said body to operate in scissors fashion relative to said first leg;

a curling clamp pivotally connected to said body for exerting a clamping force against one of said first and second legs; and a latch associated with said handle end for releasably securing said pivoting portion to said grip portion.

2. The hair styling iron of claim 1 wherein said iron has a main pivot point disposed generally midway between said handle end and said styling end.

3. The hair styling iron of claim 1 wherein said at least one latch configured so that, when closed, said first and second legs are secured together.

4. The hair styling iron of claim 1 wherein said pivoting portion is biased to an open position.

5. The hair styling iron of claim 1 wherein both of said first and second legs have an opposed relatively planar surface, and a relatively semicircular surface.

6. The hair styling iron of claim 5 wherein said curling clamp is configured for exerting a biasing force against said relatively semicircular surface of said first leg.

7. The hair styling iron of claim 1 wherein said first and second legs are generally tubular, and are pivotable between an open position and a closed position.

8. The hair styling iron of claim 7 wherein said legs define a generally cylindrical shape when in said closed position.

9. The hair styling iron of claim 8 wherein said handle end defines a generally cylindrical shape when in said closed position.

10. A hair styling iron, comprising:

a body with a handle end configured for being gripped by a user, and a styling end opposite said handle end;

said styling end including a first leg and a second leg, each said leg having at least one heated surface, said legs being movable between an open position and a closed position;

said handle end being configured for moving said second leg relative to said first leg and including a grip portion and a pivoting portion connected to said second leg for providing pivoting movement relative to said first leg, said pivoting portion of said handle end and said second leg are connected to said body to operate in scissors fashion relative to said first leg;

a latch being provided to said handle end for releasably attaching said grip portion to said pivoting portion for retaining said legs in said closed position; and a curling clamp pivotally connected to said iron for exerting a clamping force against one of said first and second legs.

11. The hair styling iron of claim 10 wherein said curling clamp is controllable independently of said position of said legs.

12. The hair styling iron of claim 11 further including a handle on said curling clamp for controlling the position of said clamp relative to said legs.

13. The hair styling iron of claim 10 further including a spring for biasing said legs to said open position.

14. The hair styling iron of claim 10 further including an insulating tip disposed at said styling end.

15. The hair styling iron of claim 14 wherein said insulating tip is provided with a plurality of cooling fins.

16. A hair styling iron, comprising:

a body with a handle end configured for being gripped by a user, and a styling end opposite said handle end;

said styling end including a first leg and a second leg, each said leg having at least one heated surface, said legs being movable between an open position and a closed position;

said handle end provided with a grip portion and a pivoting portion configured for moving said second 1e relative to said first leg, said pivoting portion connected to said second leg independent of said handle end for providing pivoting movement relative to said first leg, said pivoting movement occurring about a pivot axis located in a center portion of said body;

said grip portion defining a recess configured for receiving said pivoting portion in said closed position; and a curling clamp pivotally connected to said iron for exerting a clamping force against one of said first and second legs.

* * * * *